US010130533B2

(12) United States Patent
Schneider

(10) Patent No.: US 10,130,533 B2
(45) Date of Patent: Nov. 20, 2018

(54) PATIENT CONTACT COMPENSATING WHEELCHAIR

(71) Applicant: David Kurt Schneider, Kennewick, WA (US)

(72) Inventor: David Kurt Schneider, Kennewick, WA (US)

( * ) Notice: Subject to any disclaimer, the term of this patent is extended or adjusted under 35 U.S.C. 154(b) by 861 days.

(21) Appl. No.: 13/827,971

(22) Filed: Mar. 14, 2013

(65) Prior Publication Data

US 2014/0110978 A1 Apr. 24, 2014

Related U.S. Application Data

(60) Provisional application No. 61/718,152, filed on Oct. 24, 2012.

(51) Int. Cl.

| | |
|---|---|
| ***A61G 5/10*** | (2006.01) |
| ***A61G 7/057*** | (2006.01) |
| *A61G 5/04* | (2013.01) |

(52) U.S. Cl.

CPC ..... *A61G 5/10* (2013.01); *A61G 5/1043* (2013.01); *A61G 5/1045* (2016.11); (Continued)

(58) Field of Classification Search

CPC ... A61G 5/00; A61G 5/04; A61G 5/10; A61G 5/1043; A61G 2005/1045; A61G 2005/1048; A61G 7/0573; A61G 2203/34; A61G 2005/1081; A61G 5/43; A61G 2007/05784; A61G 5/1059; A61G 2201/70; A61G 2203/46; A47C 7/72; A47C 7/74; A47C 27/122; A47C 27/083

See application file for complete search history.

(56) References Cited

U.S. PATENT DOCUMENTS

| | | | | |
|---|---|---|---|---|
| 3,404,915 A | | 10/1968 | De Souza Filho | |
| 4,279,044 A | * | 7/1981 | Douglas ..... | A43B 3/0084 5/654 |

(Continued)

OTHER PUBLICATIONS

Non-Final Office Action dated Oct. 4, 2011 from U.S. Appl. No. 12/417,159, 7 pages.

(Continued)

*Primary Examiner* — Steven Douglas

(74) *Attorney, Agent, or Firm* — Rainier Patents, P.S.; Paul W. Mitchell

(57) ABSTRACT

This patent pertains to patient contact compensating wheelchairs. One implementation includes a motorized base that includes a battery and a seat positioned above the base. In one instance, the seat can include a moisture permeable structure configured to support a patient and a fan configured to move air below the moisture permeable structure to carry moisture from the patient away from the moisture permeable structure. Another implementation includes a set of patient contact objects configured to alternatively contact first and then second portions of an underside of the moisture permeable structure so that at a first time more of the patient's weight is supported at the first portion than at the second portion and at a second time more of the patient's weight is supported at the second portion than at the first portion, to relieve contact pressure of the patient.

13 Claims, 12 Drawing Sheets

(52) U.S. Cl.
CPC ..... *A61G 5/1048* (2016.11); *A61G 5/1081* (2016.11); *A61G 7/0573* (2013.01); *A61G 7/05784* (2016.11); *A61G 5/043* (2013.01); *A61G 5/1059* (2013.01); *A61G 2203/34* (2013.01); *A61G 2203/46* (2013.01); *A61G 2210/70* (2013.01)

(56) References Cited

U.S. PATENT DOCUMENTS

| | | | | |
|---|---|---|---|---|
| 4,389,057 | A | 6/1983 | Richard, Jr. | |
| 4,966,145 | A * | 10/1990 | Kikumoto | A47C 7/74 165/46 |
| 5,096,257 | A | 3/1992 | Clark | |
| 5,168,889 | A | 12/1992 | Diestle | |
| 5,203,363 | A | 4/1993 | Kidwell et al. | |
| 5,205,308 | A | 4/1993 | Kendall et al. | |
| 5,301,975 | A | 4/1994 | Rivera | |
| 5,489,002 | A | 2/1996 | Streiff | |
| 5,560,383 | A | 10/1996 | Fuller | |
| 5,592,706 | A * | 1/1997 | Pearce | A47C 27/083 5/654 |
| 5,725,062 | A | 3/1998 | Fronek | |
| 5,921,258 | A | 7/1999 | Francois | |
| 6,014,784 | A * | 1/2000 | Taylor | A61G 7/05776 297/284.6 |
| 6,102,479 | A | 8/2000 | Wallace | |
| 6,269,504 | B1 * | 8/2001 | Romano | A47C 27/122 5/653 |
| 6,313,394 | B1 | 11/2001 | Shugar et al. | |
| 6,586,668 | B2 | 7/2003 | Shugar et al. | |
| 7,140,678 | B1 | 11/2006 | Grant | |
| 7,243,990 | B1 | 7/2007 | Wahl | |
| 7,316,450 | B2 | 1/2008 | Ayers et al. | |
| 7,374,238 | B2 | 5/2008 | Lingwall | |
| 7,585,020 | B1 | 9/2009 | Wahl, Jr. | |
| 7,815,254 | B2 | 10/2010 | Reeb et al. | |
| 8,215,421 | B2 * | 7/2012 | Schneider | A61G 5/10 180/2.2 |
| 8,448,728 | B2 | 5/2013 | Schneider | |
| 8,640,796 | B2 | 2/2014 | Wilson et al. | |
| 9,056,037 | B1 * | 6/2015 | Thomas | A61G 7/05776 |
| 2004/0237203 | A1 * | 12/2004 | Romano | A47C 27/122 5/713 |
| 2008/0084095 | A1 * | 4/2008 | Wolas | A47C 7/72 297/180.11 |
| 2010/0193262 | A1 | 8/2010 | Zhao | |
| 2010/0225488 | A1 * | 9/2010 | Hinterlong | G08B 21/0461 340/573.4 |
| 2013/0186697 | A1 * | 7/2013 | Schneider | B60L 8/003 180/2.2 |
| 2014/0115790 | A1 * | 5/2014 | Romano | A47C 27/122 5/652.2 |
| 2014/0159489 | A1 | 6/2014 | Cough | |

OTHER PUBLICATIONS

Response filed Jan. 3, 2012 to the Non-Final Office Action dated Oct. 4, 2011 from U.S. Appl. No. 12/417,159, 14 pages.
Notice of Allowance dated Mar. 20, 2012 from U.S. Appl. No. 12/417,159, 5 pages.
Non-Final Office Action dated Mar. 26, 2012 from U.S. Appl. No. 13/350,015, 8 pages.
Response filed Jul. 25, 2012 to the Non-Final Office Action dated Mar. 26, 2012 from U.S. Appl. No. 13/350,015, 8 pages.
Applicant-Initiated Interview Summary dated Aug. 3, 2012 from U.S. Appl. No. 13/350,015, 3 pages.
Notice of Allowance dated Oct. 29, 2012 from U.S. Appl. No. 13/350,015, 5 pages.
Notice of Allowance dated Feb. 13, 2013 from U.S. Appl. No. 13/350,015, 6 pages.
Requirement for Restriction/Election dated May 5, 2014 from U.S. Appl. No. 13/736,828, 5 pages.
Response filed Sep. 5, 2014 to the Requirement for Restriction/Election dated May 5, 2014 from U.S. Appl. No. 13/736,828, 6 pages.
Non-Final Office Action dated Oct. 3, 2014 from U.S. Appl. No. 13/736,828, 9 pages.
Response filed Mar. 3, 2015 to the Non-Final Office Action dated Oct. 3, 2014 from U.S. Appl. No. 13/736,828, 10 pages.
Non-Final Office Action dated Jul. 6, 2015 from U.S. Appl. No. 13/736,828, 5 pages.
Response filed Dec. 3, 2015 from the Non-Final Office Action dated Jul. 6, 2015 from U.S. Appl. No. 13/736,828, 12 pages.
U.S. Appl. No. 61/584,708 titled "Solar Shade," filed Jan. 9, 2012 by inventor David Kurt Schneider, 45 pages.
U.S. Appl. No. 61/718,152 titled "Patient Contact Compensating Wheelchairs," filed Oct. 24, 2012 by inventor David Kurt Schneider, 106 pages.
Boycott, Rosie, "Driven by the sun," The Guardian, Guardian New and Media Limited, May 14, 2008, 5 pages.
Quick, Darren., "Across the UAE in eleven days in a solar-powered wheelchair," Gizmag, Nov. 21, 2010, 7 pages.
Non-Final Office Action dated Aug. 26, 2016 from U.S. Appl. No. 13/736,828, 15 pages.
Final Office Action dated Mar. 10, 2016 from U.S. Appl. No. 13/736,828, 7 pages.
Response filed Aug. 9, 2016 to the Final Office Action dated Mar. 10, 2016 from U.S. Appl. No. 13/736,828, 13 pages.
Final Office Action dated May 4, 2017 from U.S. Appl. No. 13/736,828, 11 pages.
Response filed Jan. 11, 2017 to the Non-Final Office Action dated Aug. 26, 2016 from U.S. Appl. No. 13/736,828, 11 pages.

* cited by examiner

PATIENT CONTACT COMPENSATING WHEELCHAIR

PRIORITY

This application is a utility application that claims priority from provisional application 61/718,152 filed 2012 Oct. 24, which is incorporated by reference in its entirety.

BACKGROUND

Wheelchairs are often prescribed to patients that have lower body (e.g., pelvic or leg) injury or illness and/or impaired nervous system control of the lower body. Accordingly, the patients are often confined to their wheelchairs for long periods of time. Further, many of these patients are unable to shift their position on the wheelchair. For these reasons, the same regions of the patient, such as the posterior region of the upper legs and the buttocks tend to remain in contact with the wheelchair for prolonged periods. Accordingly, this continuous contact between these regions of the patient and the wheelchair can cause problems for the tissues of these regions. For instance, contact pressure, or pressure in combination with shear and/or friction, between these regions and the wheelchair can decrease circulation to and from these tissues, or cause muscle cramping or other tension or stress. Also, the contact can reduce or prevent heat dissipation from these tissues and cause overheating of the tissues. Alternatively or additionally, the contact may reduce or prevent water evaporation away from these regions. Over time, these conditions can cause various problems to the tissues, such as decubitus ulcers, skin degeneration, excessive bacterial and/or fungal populations, positioning issues (problems with the back, hips, and/or spine), shear factor issues (starting and stopping, turning, friction, jarring, etc., mostly behind the legs under the hamstring to the knee area), among other issues.

The described implementations offer the capacity to be a preventative to the number of body issues one could suffer from being in a conventional wheelchair. The present concepts address these health issues and thereby not only save lives but contribute to a higher quality of life.

SUMMARY

This patent pertains to patient contact compensating wheelchairs. One implementation includes a motorized base that includes a battery, and a seat positioned above the base. In one instance, the seat includes a moisture permeable structure configured to support the patient and a fan configured to move air below the moisture permeable structure to carry moisture away from the seat where the user (e.g., the patient) contact occurs. Another implementation includes contact objects configured to be adjusted so that the weight of the patient is supported at a first portion and then at a second portion, to relieve contact pressure of the patient.

The above listed examples are provided for introductory purposes and do not include all of, and/or limit, the claimed subject matter.

BRIEF DESCRIPTION OF THE DRAWINGS

The accompanying drawings illustrate implementations of the concepts conveyed in the present application. Features of the illustrated implementations can be more readily understood by reference to the following description taken in conjunction with the accompanying drawings. Like reference numbers in the various drawings are used wherever feasible to indicate like elements. Further, the left-most numeral of each reference number conveys the figure and associated discussion where the reference number is first introduced.

DETAILED DESCRIPTION

Overview

The inventive concepts can address or compensate for contact issues between a patient and a wheelchair and as such are referred to as patient contact compensating wheelchairs. As used herein, the term wheelchair is intended to be given a broad definition to include any type of wheeled personal mobility apparatus, such as "wheelchairs," "scooters," etc.

The implementations of the patient contact compensating wheelchair concepts can address pressure, temperature, moisture, and/or positioning issues associated with the contact. As mentioned above, often the contact issues are pronounced where the patient contacts a seat of the wheelchair with his/her buttocks, but the contact issues could also occur between the patient's back and a seat back of the wheelchair and/or the patient's head/neck and a headrest of the wheelchair, among other regions. Specific structures for accomplishing this contact compensation are described in more detail below relative to FIGS. 1-12.

EXAMPLES

Figure 1:
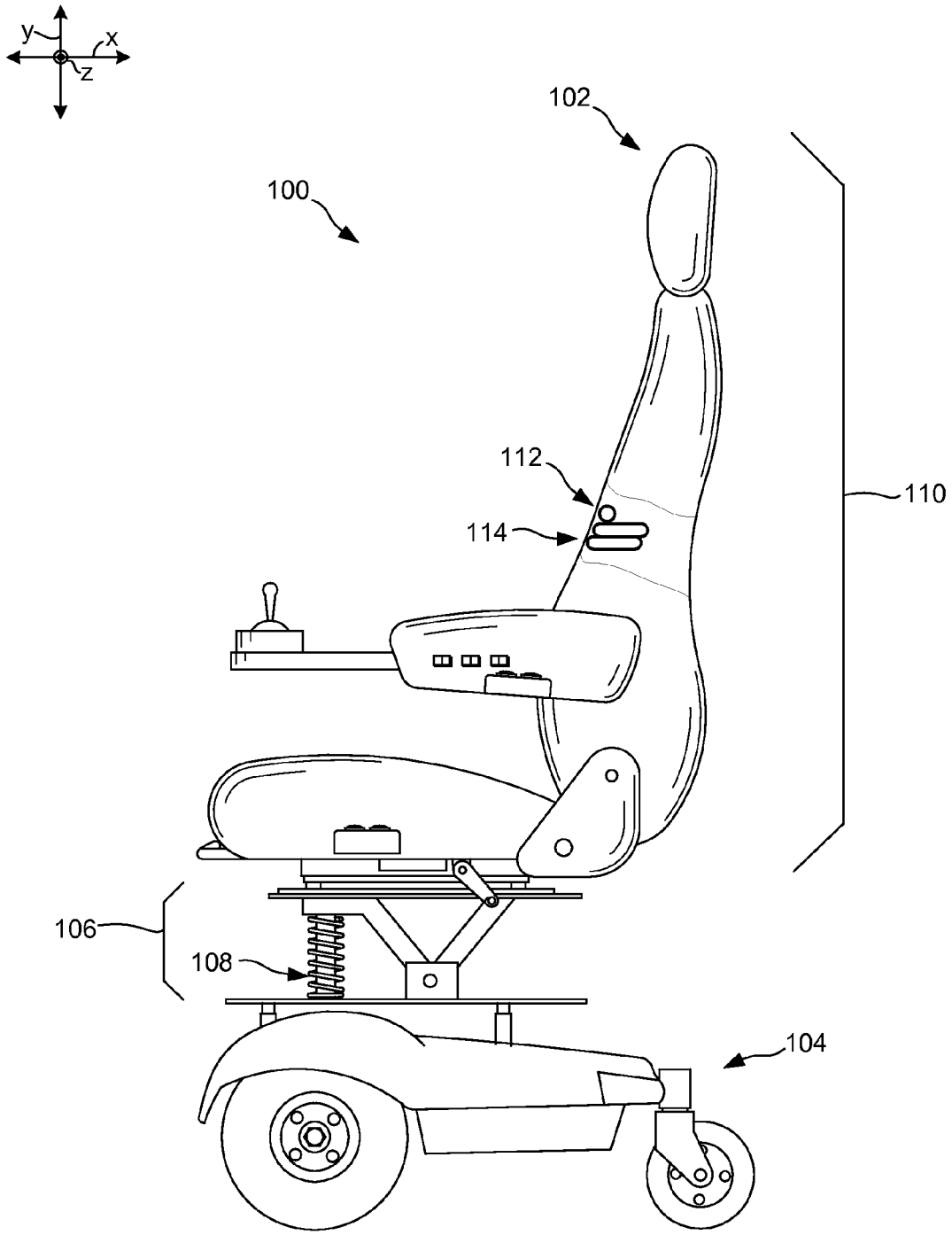
FIG. 1 is a side view of an example wheelchair that is consistent with patient contact compensating concepts in accordance with some implementations.

FIGS. 1 through 6 collectively illustrate implementations of a patient contact compensating wheelchair 100. As shown in FIG. 1, one implementation of the patient contact compensating wheelchair 100 can include a seat 102 positioned above a base 104. In this case the base is motorized and wheeled. The seat 102 and the base 104 can be connected via an interface 106. The interface can include a suspension system 108. Examples of suspensions systems are described in more detail below relative to FIG. 7. An example interface is discussed relative to FIG. 8.

In this implementation, seat 102 can include a patient contact compensating system 110. The patient contact compensating system 110 can be configured to address pressure, temperature, moisture, and/or positioning issues associated with the contact between the patient and the seat 102. In this case, the patient contact compensating system 110 can include a contact temperature compensating subsystem 112 and a contact pressure compensating subsystem 114 (indicated generally in a cutaway of a portion of seat 102). These elements of the patient contact compensating system will be described in further detail below.

Figure 2:
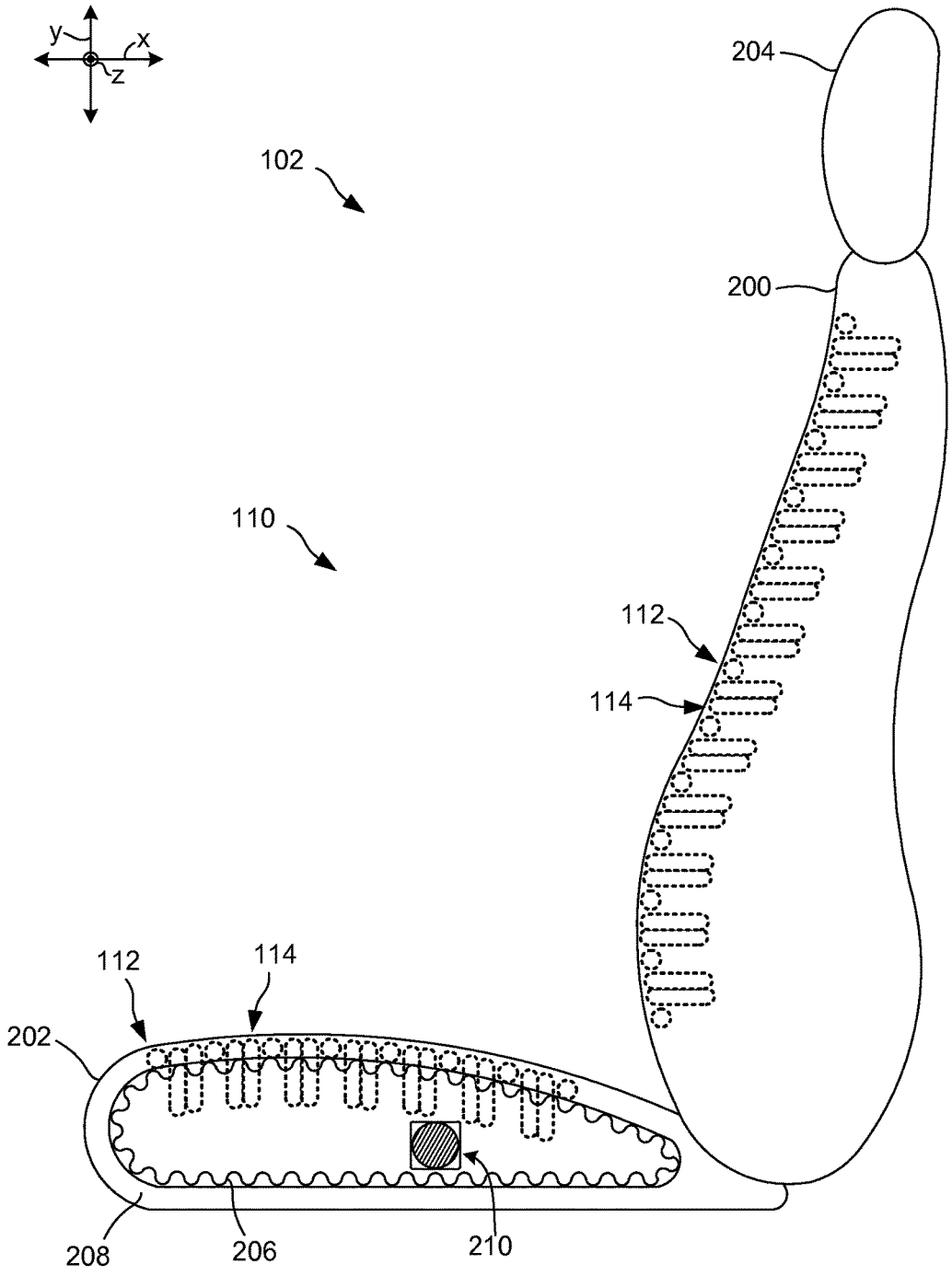
FIG. 2 is a sectional view showing an example patient contact compensating system of the wheelchair of FIG. 1.

FIG. 2 is a sectional view of the example seat 102 and patient contact compensating system 110 introduced above. As shown in FIG. 2, the seat can include such elements as a seat back 200, a seat bottom 202, and/or a headrest 204. The seat can also include other elements, such as armrests (shown but not designated in FIG. 1). As shown in FIG. 2, these elements, such as the seat bottom 202, can consist of a support structure 206 supporting a covering 208 in some implementations. Certain elements of the patient contact compensating system 110, such as the contact temperature compensating subsystem 112 or the contact pressure compensating subsystem 114, can be placed inside the seat bottom 202, the seat back 200, or other elements of the seat 102. The contact temperature compensating subsystem 112 and the contact pressure compensating subsystem 114 are discussed in more detail below relative to FIGS. 3A through 6.

Referring to FIG. 2, a patient may experience elevated temperatures at contact regions between the body of the patient and the seat back 200, the seat bottom 202, and/or another contact region, where compensation for patient contact with the seat 102 can be advantageous. The seat 102 may include a fluid circulating device 210. Some implementations of the patient contact compensating system 110 can address the issue of temperature with the fluid circulating device 210, by circulating a fluid proximate to a portion of the seat 102 where the patient contact occurs. For instance, in some implementations, the fluid may be air that is directed through the portion of the seat to increase heat dissipation from the affected contacting tissues. In some of these implementations, the seat can be configured in such a manner to allow moisture proximate to the contacted tissues to be carried away by the circulating air. For example, the seat covering 208 may be a moisture permeable structure that allows moisture to evaporate from the contact region. In another implementation, fluid can be circulated in or around the seat 102 proximate to the contacting tissues in a closed system, such as a refrigerating system where the refrigerant picks up heat near the contacting tissues and gives up that heat at a more distal location, such as close to the surface that the wheelchair is positioned upon (e.g., the ground). In some configurations, where the refrigerant is in a vapor phase near the contacting tissues the refrigerant can also provide a desiccating effect to reduce moisture build-up on the contacting tissues.

The seat covering 208 can be made from any of various materials, such as leather, vinyl, or cloth, designed for the comfort of the patient using the patient contact compensating wheelchair 100. For example, the covering can be selected for comfort next to a person's skin, among other potentially desirable material properties. In the illustrated configuration, the support structure can be a wire frame or skeleton over which the covering is positioned. In other implementations, the seat elements can be made from a single material, and may have a protective coating. Also, the elements may be a single or multiple pieces. For example, the seat back can consist of three pieces. Still other seat configurations are contemplated.

Figure 3A:
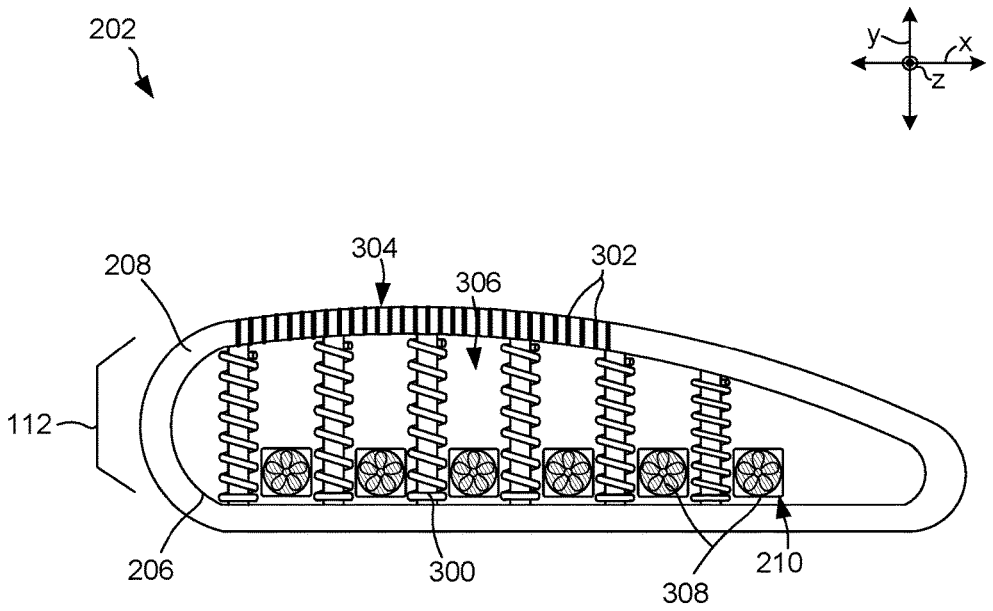
FIGS. 3A and 3B are sectional views of an example seat bottom that includes the patient contact compensating system, showing a contact temperature compensating subsystem in accordance with some implementations of the present concepts.
Figure 3B:
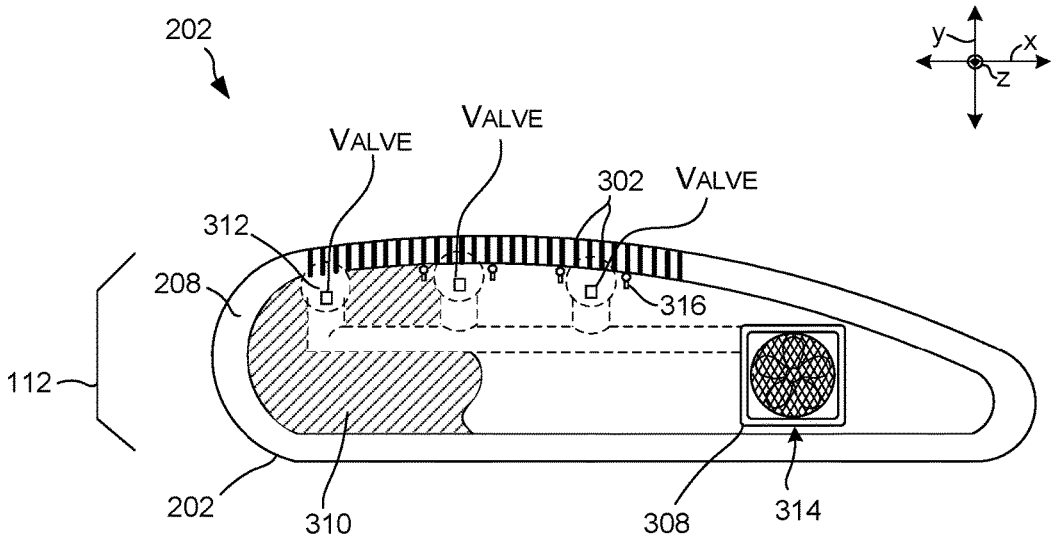

FIGS. 3A and 3B show close-up sectional views of versions of the seat bottom 202 and collectively illustrate some implementations of the contact temperature compensating subsystem 112. In the implementation shown in FIG. 3A, the seat bottom 202 can include support structure 206, covering 208, and fluid circulating device 210 as discussed above. In this case, the support structure can be a flexible frame, and the interior of the seat may be hollow and include springs 300 or other structures for providing support and/or improving the comfort of the seat.

As noted above, the seat covering 208 can be a moisture permeable membrane. In the illustrated configuration the seat covering can be manifest as generally solid material that has laser-ported holes 302 formed therein that extend through the covering, from a surface 304 of the seat bottom 202 into an interior 306 of the seat bottom. The laser-ported holes can allow air to circulate through the seat bottom and reduce excessive moisture buildup and/or overheating of the patient's skin. This configuration can reduce or eliminate skin degeneration, due to perspiration, and help keep the buttock region cool. The laser-ported holes 302 can be strategically spaced to aid in air circulation of the buttock and tuberosity region eliminating heat, moisture, and possible Decubitus ulcer build up, or the laser-ported holes may be placed throughout regions of the seat covering 208 that are contacted by the patient. Laser-ported holes may also be placed in the seat back 200, armrests, headrest 204, and/or other elements of the seat 102 to aid in air circulation and moisture abatement. Air can flow freely through the laser-ported holes in the seat covering 208, or air circulation can be enhanced in some implementations by fluid circulating device 210, which can be a fan 308, such as a variable speed fan. In this case the fluid circulating device 210 is manifest as multiple individually controllable fans 308. Individual fans can be controlled to provide air circulation to specific regions of the seat bottom 202.

In another implementation, illustrated in FIG. 3B, the seat bottom 202 can include a core material 310 (shown in FIG. 3B as areas with a diagonal line pattern for simplicity). Air circulation through the core material can be provided in some implementations of the patient contact compensating system 110 by air ducts 312. The air ducts 312 can be tunnels or plenums through the core material configured to supply fluid flow proximate to portions of the seat bottom 202 contacted by the patient. The air can flow freely through the air ducts, or can be forced with the fluid circulating device 210, in this case manifest as fan 314. The air ducts 312 may contain valves so that air may be directed to certain portions of the contact temperature compensating subsystem 112. In this manner, contact temperature compensation may be directed to specific regions. In addition to the air ducts 312, the core material and/or covering can also have laser-ported holes 302. The laser-ported holes can connect to the air ducts to aid in air circulation and moisture abatement. The core material can be selected from any of various materials designed for the comfort of the patient using the patient contact compensating wheelchair 100, such as for cushioning properties, among other potentially desirable material properties. The core material may fill the area inside the covering 208. The core material may act as the support structure 206 for the seat bottom. Springs or other support structures may also be included inside the core material. In another configuration, the core material may function as the support structure and/or the seat covering 208.

Though contact temperature compensating subsystem 112 has been described above relevant to cooling the patient using the patient contact compensating wheelchair 100, in some implementations the contact temperature compensating subsystem can be used to bring heat in for using the wheelchair in low temperature environments. A heating element can be used to warm air that is in turn passed through the air ducts 312 by the fluid circulating device 210. Alternatively the heating element may heat the core material 310 and/or covering 208 more directly.

Some of the present implementations can be 'smart' implementations that can monitor the patient and utilize data from the monitoring as an input for determining how to decrease patient contact issues. For instance, some implementations can monitor temperatures of patient tissues proximate to and/or contacting the wheelchair seat 102 (FIG. 2). Toward this end, the implementation of FIG. 3B shows sensors 316 positioned proximate to portions of the wheelchair seat 102 that are contacted by the patient. Only a few sensors 316 are illustrated to reduce clutter on the drawing page. Briefly, various types of sensors, such as temperature sensors, moisture sensors, and/or pressure sensors, can be employed to sense conditions proximate to the patient. The sensed conditions can be used as control parameters (e.g., feedback) for controlling the contact temperature compensating subsystem 112 and the contact pressure compensating subsystem 114.

Figure 4A:
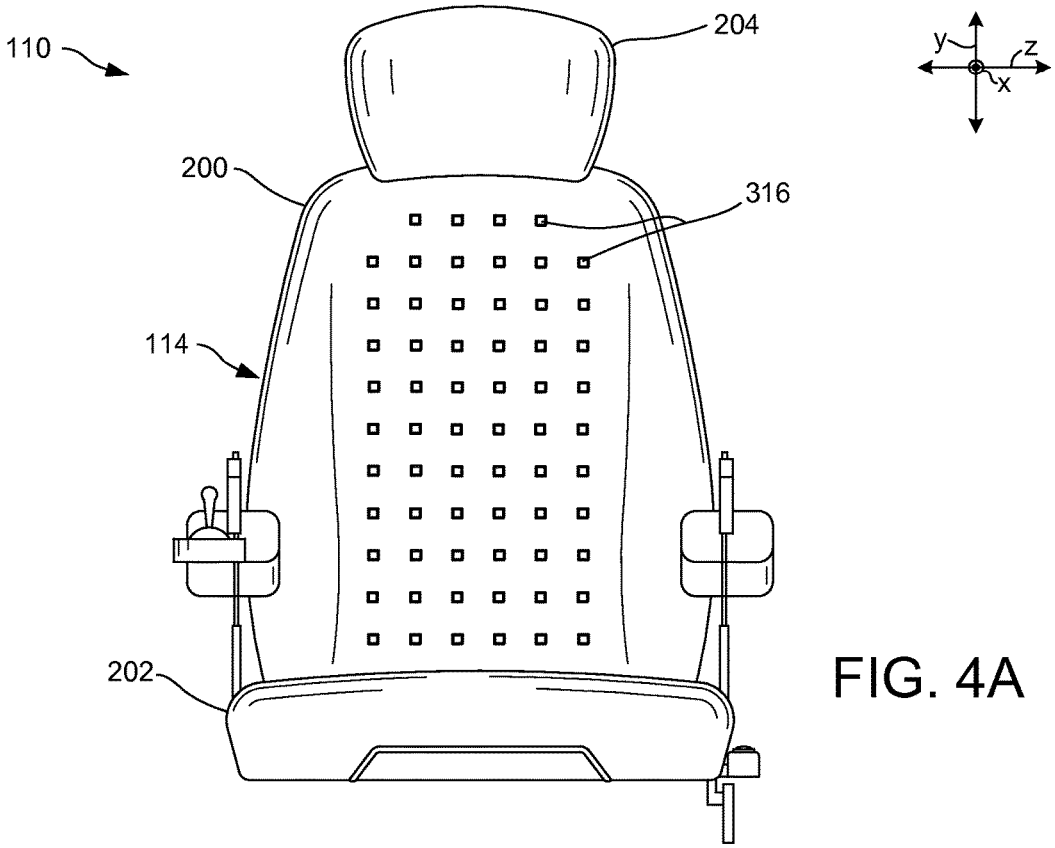
FIGS. 4A and 4B are frontal and top views of the example patient contact compensating system.
Figure 4B:
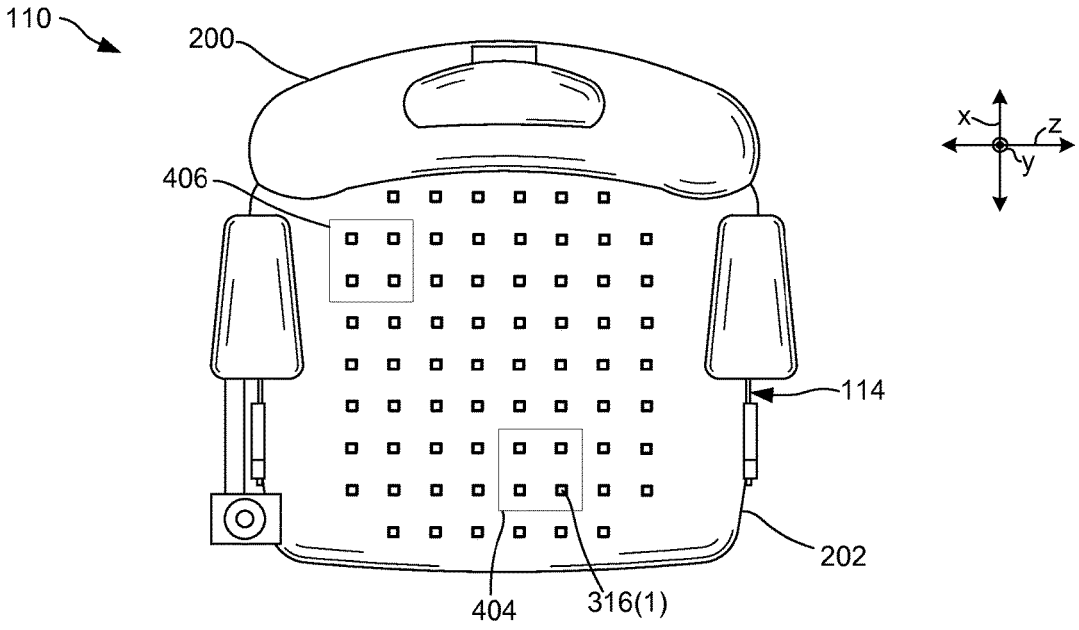

FIG. 4A shows a frontal view of the patient contact compensating system 110 and FIG. 4B shows a top view. As illustrated in FIG. 4A, multiple sensors 316 can be embedded in the seat back 200, such as in an array or a grid pattern that generally lies in a plane described by the y and z axes. As illustrated in FIG. 4B, the sensors 316 may also be placed in the seat bottom 202, generally in a plane described by the x and z axes. The sensors may also be placed in the armrests, headrest 204, or another part of the seat where patient contact with the seat occurs. Note that for purposes of explanation, the sensors 316 are illustrated as being visible on the covering 208 of the seat back 200, in other cases, the sensors can be under or in the covering in a manner that the sensors are not externally visible.

The sensors 316 can include one or more types of temperature sensors, such as contact-type temperature sensors. The sensors can also include moisture sensing devices placed similarly in the cushions or other parts of the wheelchair. Moisture sensors can be skin conductance, or galvanic skin response sensors (galvanometers), that measure the pulse rate and perspiration of a person. Increase in these metrics can be interpreted as tension or stiffness, which may indicate an area that needs relief. Further still, the sensors can be manifest as pressure sensors (discussed below relative to FIG. 5). Some implementations can employ moisture sensors, temperature sensors, and pressure sensors, either as integrated units (multiple functions performed by an individual sensor) or distinct units (e.g., individual sensors dedicated to performing a specific function).

Feedback from the sensors 316 can be used to automatically control various attributes of the patient contact compensating system 110, such as the fan 314 (FIG. 3B) for forcing air through the air ducts 312. For instance, if the sensed temperature and/or moisture values are above a threshold value, the fan can be automatically activated until the sensed value falls below the threshold value. In cases where the monitored patient temperatures are above a predefined threshold, various cooling functionalities can be started and/or increased. Some implementations may take a single temperature reading from the patient and increase or decrease cooling function based upon that reading. Other implementations can take multiple readings. For instance, temperature sensors placed in a grid pattern as shown in FIG. 4B can be used to address temperature issues in specific grid areas and hence specific tissue regions. For example, a temperature sensor 316(1) of a grid area 404 in the seat bottom 202 could indicate that the temperature of that grid area is above a predefined temperature value, while other grid areas, such as grid area 406, are not. This could indicate that the patient's tissue contacting grid area 404 of the seat bottom may also be experiencing an elevated temperature, and cooling that grid area may be advantageous to the patient. Some implementations can target cooling a specific grid area (and therefore contacting tissue) more than other grid areas. Similarly, air flow can be targeted to areas with increased moisture. For instance, individual fans can be turned on to direct air flow to the affected grid area and/or ducts can be opened and closed in a manner that directs air flow to the affected grid area.

Another example of a patient contact compensating system 110 (FIG. 2) can address pressure issues of the contacting tissues. These issues can be addressed by the contact pressure compensating subsystem 114. The patient using the patient contact compensating system 110 may experience pressure at contact regions between the body of the patient and the seat bottom 202, the seat back 200, or another contact region, where compensation for patient contact with the chair can be advantageous. In some implementations, regions of the seat can be adjusted to compensate for these pressure issues. These implementations may decrease pressure to an area which is contacting the patient tissues at a relatively high pressure (e.g., pounds per square inch), or may change the contact pressure distribution over time. Several such examples are described relative to FIG. 5.

Figure 5:
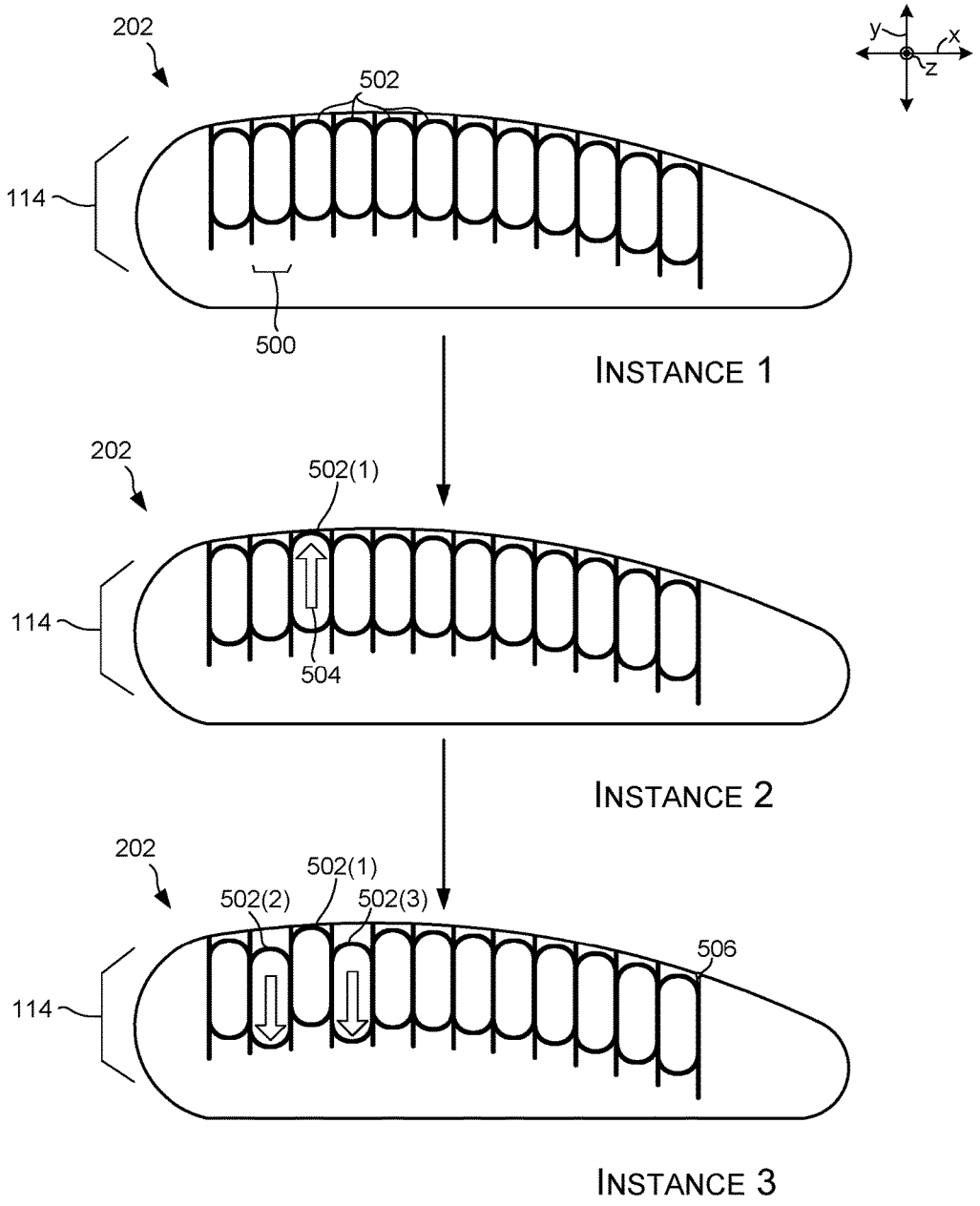
FIG. 5 shows sectional views of an example seat bottom, showing a contact pressure compensating subsystem in accordance with some implementations of the present concepts.

FIG. 5 illustrates three instances of contact pressure compensating subsystem 114. Assume that the seat bottom 202 is generally planar and lies perpendicular to the y axis of the x-y-z reference axes. For purposes of explanation assume that the seat bottom 202 is divided into vertical segments 500, as shown in Instance 1. These segments can contain patient contact objects 502.

As illustrated at Instance 2, some implementations of the contact pressure compensating subsystem 114 may raise an individual patient contact object 502(1) (upward relative to the y reference axis) as shown by arrow 504 to transfer more of the weight of the patient to tissues over the individual patient contact object 502(1). This act can thereby decrease contact pressure on other surrounding tissues that may be experiencing relatively high pressure, or to provide relief to these surrounding tissues that have been in contact with the seat bottom 202 for a length of time.

Alternatively or additionally, as illustrated in Instance 3, other proximate patient contact objects 502(2) and 502(3)

can be lowered to increase the relieving effect for the region surrounding patient contact object 502(1). Subsequently, patient contact objects 502(2) and 502(3) can be raised while patient contact object 502(1) is lowered. Of course, any combination of individual patient contact objects can be controlled to 'vary' the pressure experienced by individual portions of the patient's tissue over time. The patient contact objects 502 can be configured to be independently controllable vertically, horizontally, and/or rotationally, among other variations of movement. The patient contact objects 502 may also be placed in the seat back 200 (FIG. 2) or other contact regions.

These pressure changing techniques can be repeated periodically and/or from time to time to reduce an individual region or portion of contacting tissue from being exposed to relatively high pressure for long duration. Stated from one perspective, in essence these implementations can mimic the natural weight shifting that a person that does not have decreased lower body mobility tends to perform. These pressure changing structures can also be placed in the other cushions or parts of the seat 102 or patient contact compensating system 110.

In this example, the contact pressure compensating subsystem 114 can also include pressure sensors 506 arranged in the seat bottom 202 or other regions of the seat 102. For instance, the pressure sensors can be arranged in an analogous manner to the sensors 316 illustrated in FIG. 4, such as in a grid pattern. Pressure sensing can be performed relative to the grid in a manner similar to the temperature sensing techniques described above. In some implementations, the patient contact objects 502 can correspond to the grid pattern of the pressure sensors 506, such that an area of the pressure sensor grid pattern corresponds to a movable patient contact object of the seat bottom 202. In such a case, when relatively high pressures are sensed for an individual grid area, actions can be taken to decrease that pressure, such as by increasing pressures in proximate grid members. Alternatively, the contact pressure compensating subsystem 114 can use both time and input from pressure sensing to create a method for alternating the height of regions of the seat bottom cover over time to provide relief to the patient. Some implementations can combine these functionalities to address moisture issues, pressure issues, and/or temperature issues concurrently through various mechanisms.

Ergonomic adjustments can be made to the patient contact compensating system 110 (FIG. 2) to custom fit the seat 102 to an individual. A custom fit can help to delay some contact issues or reduce their severity. In some implementations, the seat bottom 202 can be raised at the front about 2-3 inches to hold the patient in tighter and/or to not allow for the legs to splay open further, causing positioning issues. This adjustment can be made using the movable patient contact objects 502 (FIG. 5) or by another method, such as tilting the entire seat bottom 202 (seat pan tilt). Referring to FIG. 5, the seat bottom 202 can extend or retract in the direction of the x axis to support a longer-legged person or a shorter-legged person. The seat back 200 can include a lumbar adjustment device, such as a lumbar airbag, which may be inflated or deflated to improve comfort for the patient of the wheelchair. Alternatively, this may be accomplished by other pressure changing structures, such as those discussed above. Other adjustments can be made in some implementations, such as tilting of the seat back, armrests, and/or headrest 204. Various structures may provide tilting capability, for example, a bracket (not specifically designated) may allow tilting of the seat back relative to the seat bottom. Brackets or hinges may be attached to parts of the seat cushions, a seat frame, or parts of the wheelchair to allow tilting or movement of some wheelchair parts relative to other wheelchair parts. The movements may be manually adjustable, motorized, and/or controllable.

Another example of a way to compensate for pressure on body tissue or to otherwise provide relief to a person confined in patient contact compensating wheelchair 100 and/or with limited lower body mobility is through massage. In some implementations, patient contact objects 502 can also be massage devices 600 (see FIG. 6). Massage can reduce/eliminate cramping of muscles and aid in blood flow throughout the body, while also helping relieve tension and stress at the tuberosity and spine and pelvis regions. For example, variable speed, vibration massage at the lumbar spine area of the seat back 200 can aid with blood flow and muscle relief. The massage devices 600 can be massaging rollers 602 (specific instances shown include a suffix, e.g. "602(1)") that can be built into the seat back, the seat bottom 202, and/or other parts of the seat 102.

Figure 6:
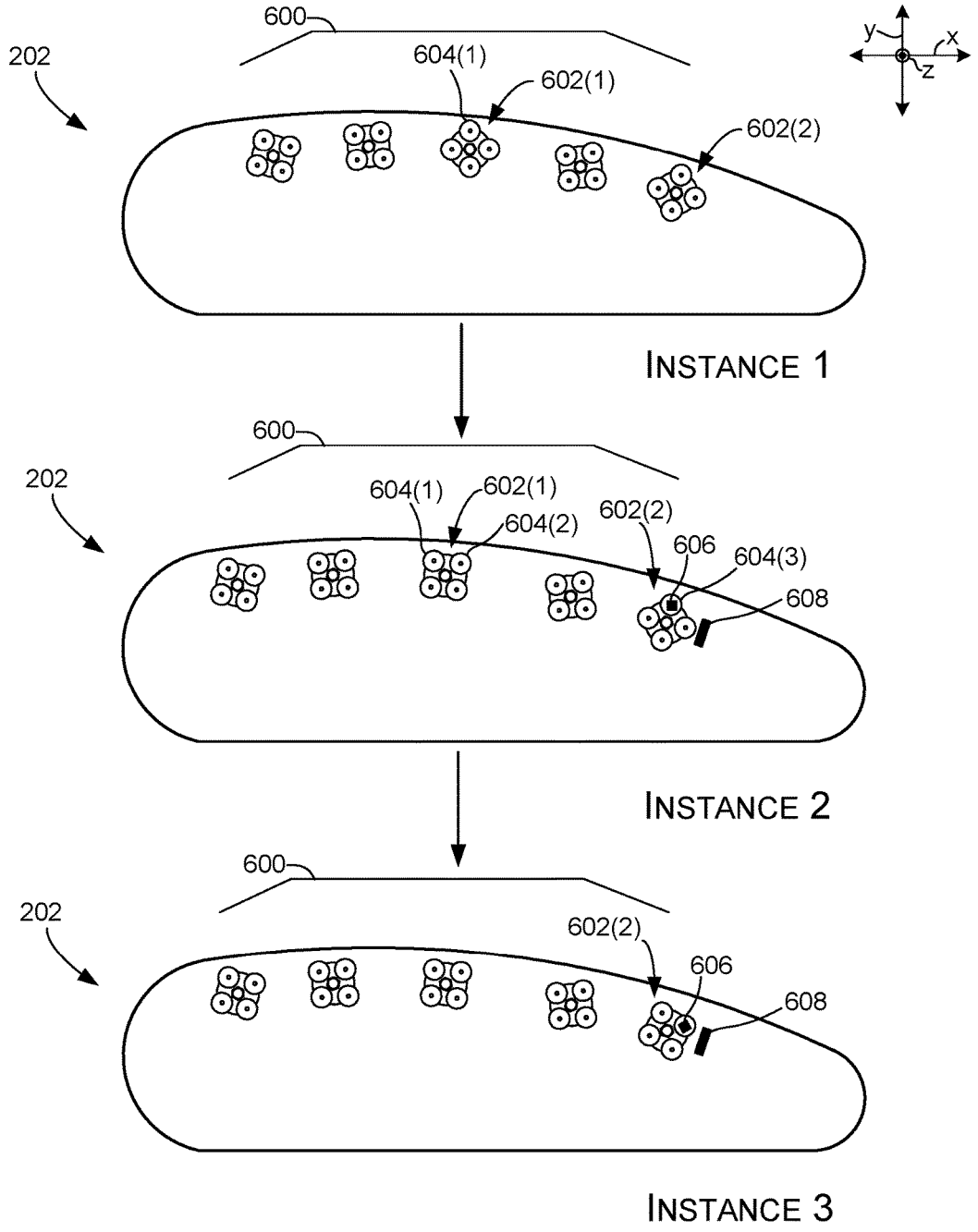
FIG. 6 shows sectional views of another example of a contact pressure compensating subsystem in accordance with some implementations of the present concepts.

The position of a massaging roller 602 can be monitored and controlled to accomplish the pressure relieving effect described above. For example, three instances are illustrated in FIG. 6. In Instance 1, a massaging roller 602(1) can be placed in the seat bottom 202. In this instance, massaging roller 602(1) is turned so that a rolling surface 604(1) is directed outward from the cushion, or in other words pressing into the body of the patient. When a change in pressure distribution over the contact region is desired, massaging roller 602(1) can be turned so that the rolling surface is no longer pressing into the body of the patient. For example, in Instance 2 massaging roller 602(1) is turned so that neither rolling surface 604(1) nor rolling surface 604(2) is directed outward from the seat bottom. Additionally, other, proximate massaging rollers may be turned to press into the body of the patient, thereby redistributing the pressure over the contact region.

Position sensors can be incorporated with the massage devices 600 to help monitor the position of the device in relation to the contact regions so that contact pressure with the patient may be controlled. For example, in Instance 2, massaging roller 602(2) has been fitted with a position sensor 606 at rolling surface 604(3). The position sensor can be any of many types of position sensors, such as position sensors that are configured to determine absolute position, arbitrary position, or rotary position. The position sensors may be contacting or non-contacting. As shown in this case, the position sensor can be configured to determine its rotary position relative to another point, such as relative to resistor 608. As shown in Instance 3, massaging roller 602(2) has been turned such that the position of position sensor 606 is changed relative to resistor 608.

The patient contact objects 502 described above relative to FIG. 5 can be manifest as various types of massage devices 600, such as kneading discs, airbags, rolling nodes, and/or vibrating elements. Some implementations can include heat incorporated with massage, variable massage intensity (soft to vigorous), squeezing airbags (such as for the lower legs), or rhythmic massage. Massage may also be accomplished by jets of water contained within impermeable membranes in the seat back 200 and/or seat bottom 202.

Figure 7:
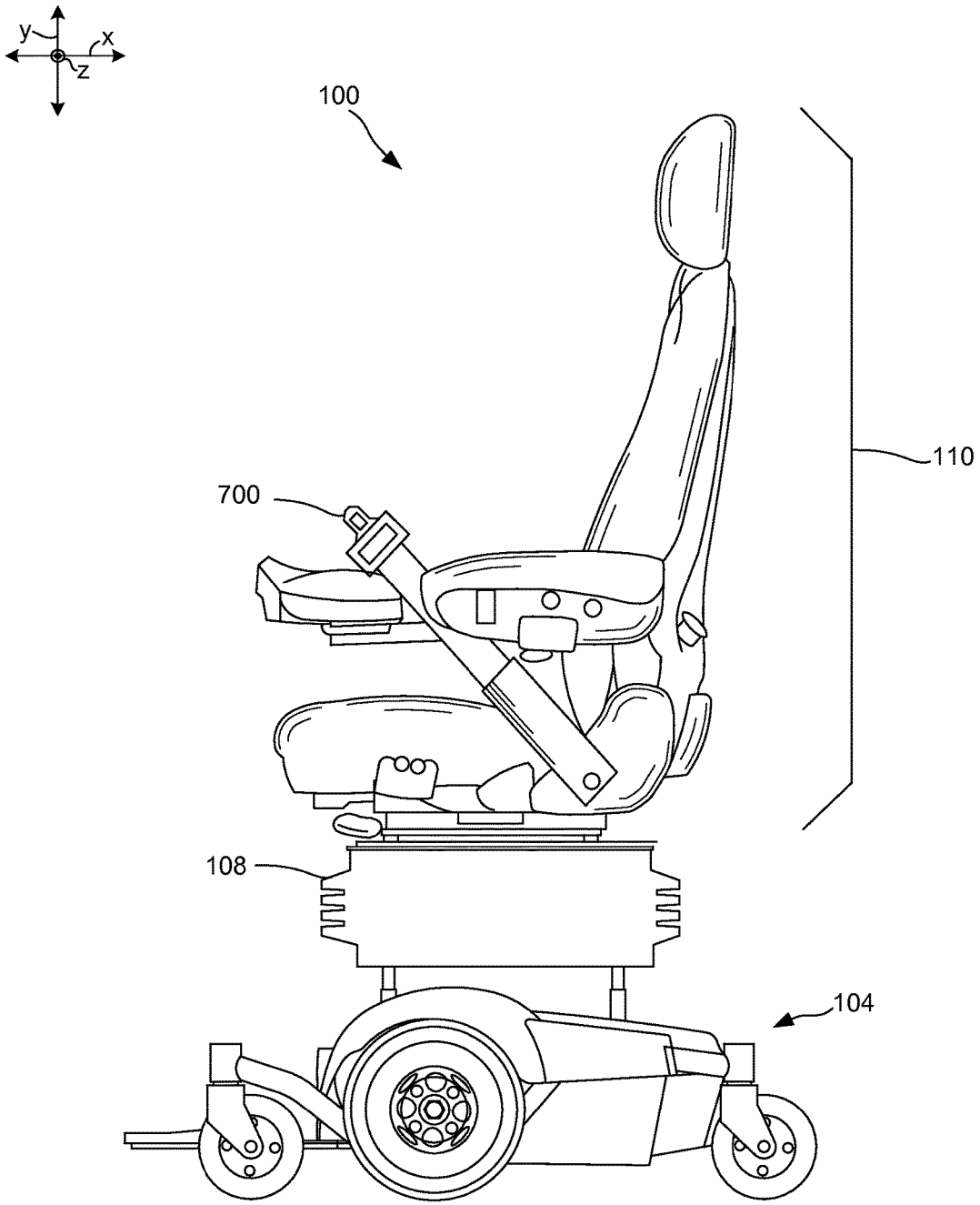
FIG. 7 shows a side view of another example wheelchair that is consistent with the patient contact compensating concepts in accordance with some implementations.

FIG. 7 shows a side view of another example of a patient contact compensating wheelchair 100 that is consistent with the patient contact compensating system 110 concepts in accordance with some implementations. In this example, the suspension system 108 is an air suspension type system. In other implementations, the suspension system 108 may be an air suspension system or mechanical suspension system to reduce or eliminate jarring, bumping, or violent movements of the patient contact compensating system when used with any base 104. In this instance, the base is a wheeled and motorized base. The suspension system can also lower shear forces or friction for the patient using the wheelchair, particularly during starting and stopping of the wheelchair. The patient using the wheelchair can adjust the firmness of the wheelchair ride by choosing a relatively stiff resistant suspension or a more resilient "squishy" suspension, either as personal preference or specifically designed for contact issues relating to jarring movements or shear forces. The suspension system can additionally be used for positioning of the person in the wheelchair, such as adjusting their height above the ground. The suspension system can be attached to a wheelchair seat, seat frame, a part of the patient contact compensating system 110, and/or to the base 104 to accomplish reduction of shear forces, accelerations, or jarring movements. The patient contact compensating system and/or seat can also include a seat belt 700, among other safety features. The seat belt can be attached to the wheelchair seat 102 or any of its parts, or to another structure of the patient contact compensating wheelchair.

Figure 8:
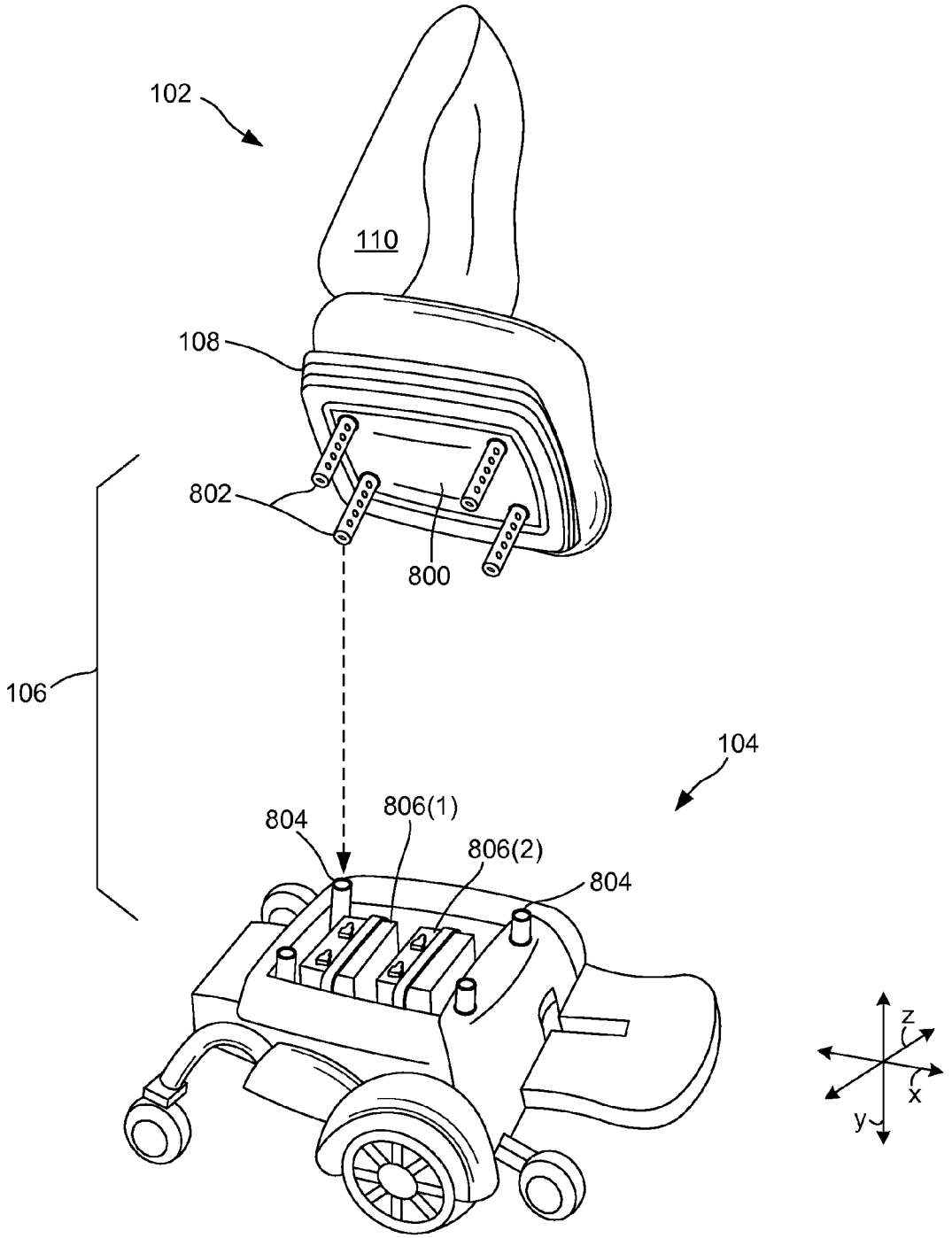
FIG. 8 illustrates an example technique for attaching a seat including a patient contact compensating system to a wheeled base.

FIG. 8 illustrates an example of how the patient contact compensating system 110 can be attached to the base 104. In this case, the patient contact compensating system 110 is positioned within seat 102. In one case, the seat is an 8000 Series-8045 seat available from Sears Manufacturing Company. In this implementation, the suspension system 108 is fastened to the seat 102. The suspension system can have a base plate 800 attached to its underside. The base plate 800 can include attachment posts 802. The attachment posts can be designed to fit into receivers 804 of the base 104. In one case, the base is a Compass from Golden Technologies. The receivers 804 can be hollow cylinders attached to the wheeled base. The attachment posts 802 can be positioned in the receivers 804 to secure the seat 102 to the base 104. In some implementations individual holes in the attachment posts can be aligned with individual holes in the receivers and fasteners, such as pins or bolts, can be used to secure the posts in the receivers. Other methods of attaching the patient contact compensating system to the wheeled base can be used. In this case, the base 104 is configured to house batteries 806(1) and 806(2).

Figure 9:
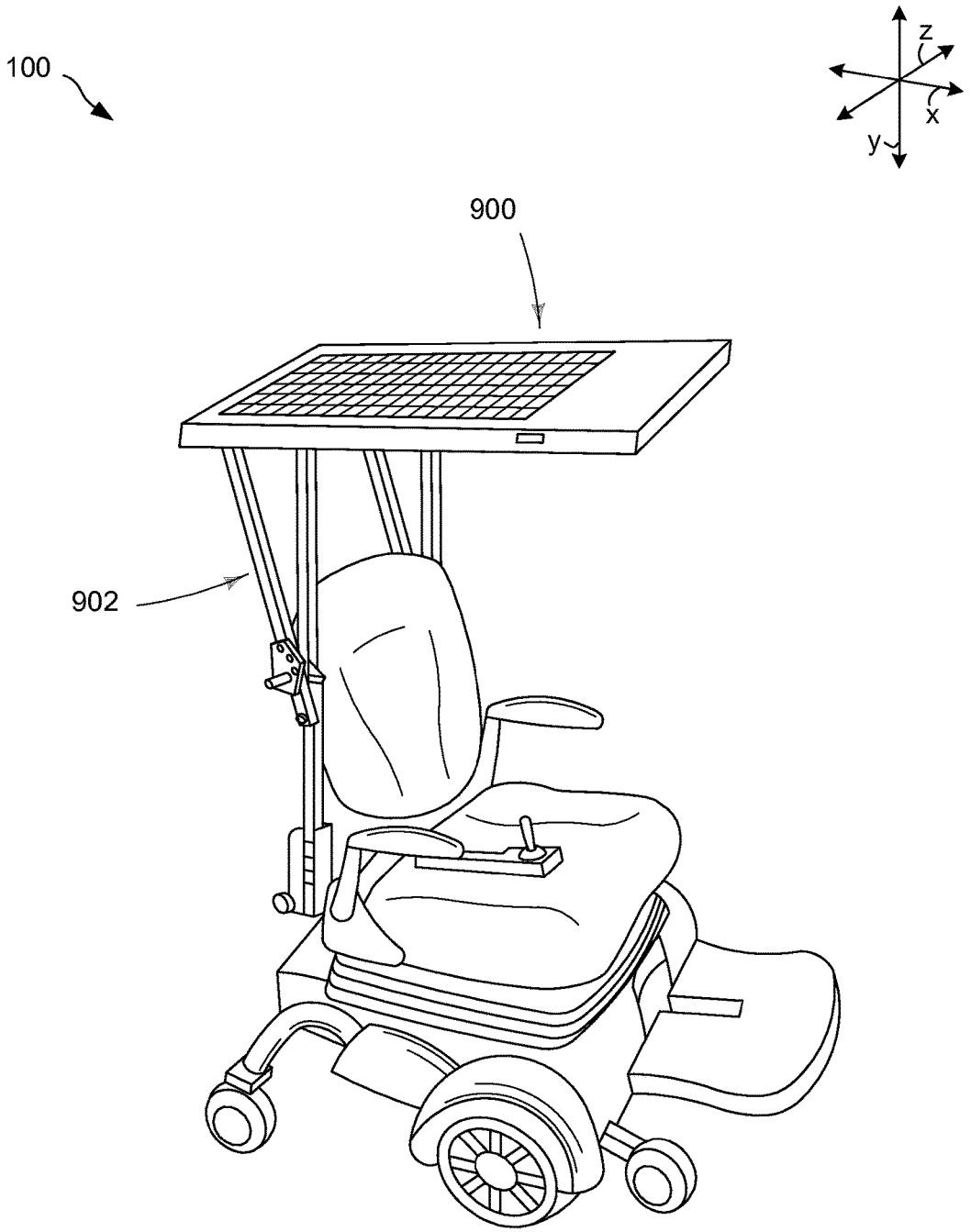
FIG. 9 shows a perspective view of an example deployable solar protector mounted on a patient contact compensating wheelchair in accordance with some implementations of the present concepts.

FIGS. 9 through 12D collectively illustrate other implementations of a patient contact compensating wheelchair 100. As shown in FIG. 9, the patient contact compensating wheelchair 100 can include a deployable solar protector 900 or deployable solar sun shade. The deployable solar protector can be supported by an associated support frame 902 which can be connected to the wheelchair, such as to the wheelchair seat and/or other structure of the wheelchair. The deployable solar protector can include a power system for the patient contact compensating wheelchair 100. The power system can include elements and circuits that are configured to be electrically interconnected with a wheelchair electrical system providing recharging power to the wheelchair battery(s) from conversion of solar energy to electrical energy. The power system can help offset the power drain of certain features of the patient contact compensating system 110.

Figure 10A:
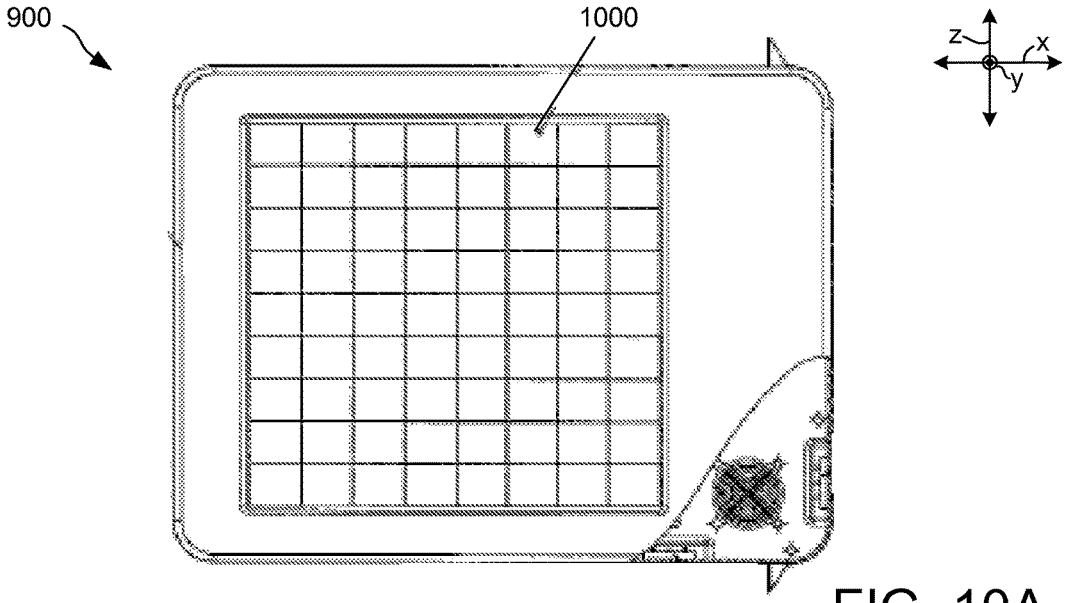
FIGS. 10A and 10B show topside and underside drawings of an example deployable solar protector in accordance with some implementations of the present concepts.
Figure 10B:
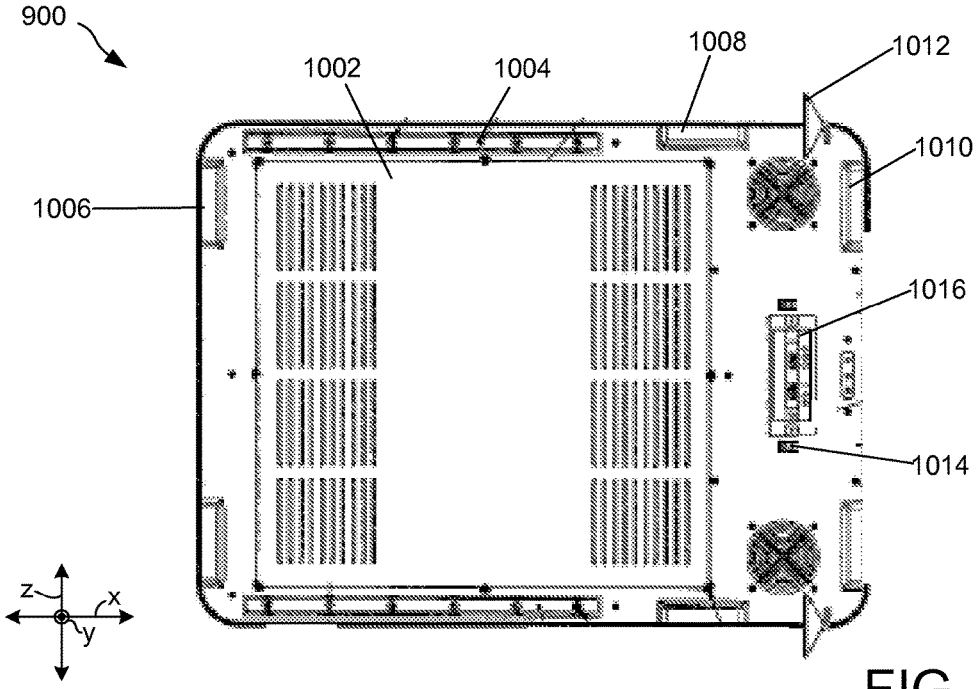
Figure 11:
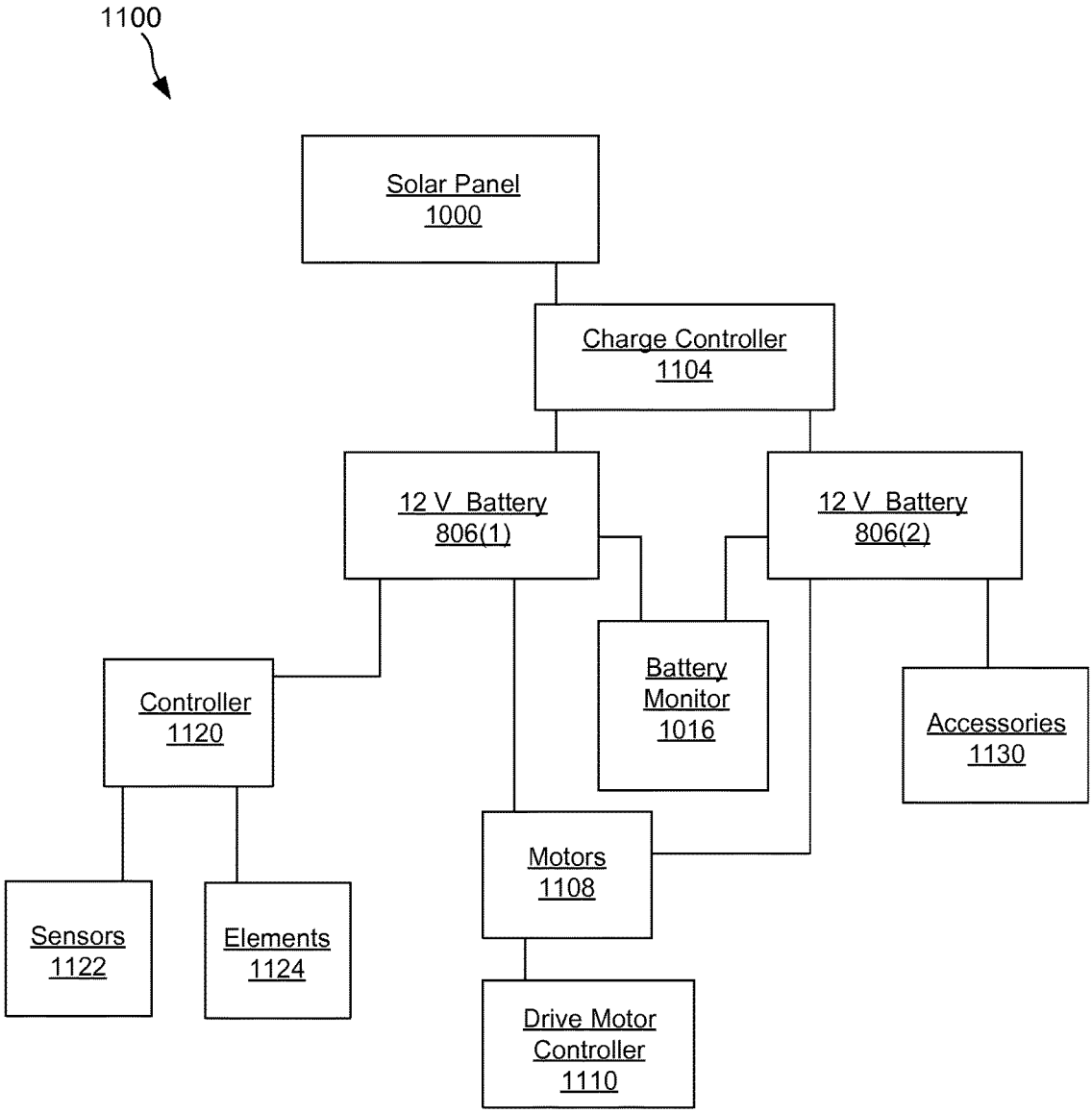
FIG. 11 is a diagram of an example power system for a patient contact compensating wheelchair in accordance with some implementations of the present concepts.

FIGS. 10A-B and 12A-D collectively illustrate example features of deployable solar protector 900 and FIG. 11 shows a schematic of a power system 1100 for the patient contact compensating wheelchair 100 in accordance with some implementations. FIG. 10A illustrates a topside of the deployable solar protector (e.g., toward the sky when deployed), while FIG. 10B illustrates an underside of the deployable solar protector (e.g., toward the patient and the ground when deployed). In some implementations, the deployable solar protector can provide shade to the occupant of the wheelchair, or shelter from rain. The deployable solar protector can include one or more solar panels 1000. The deployable solar protector can include a vented solar panel cover 1002 and a mounting bracket 1004 for mounting the deployable solar protector to the support frame 902 (see FIG. 9).

Additionally, FIG. 10B shows safety elements in accordance with some implementations. The safety elements can include color-coded LED lights (or other lights), such as Piranha LED light bars. The color-coded LED lights can be immovably affixed to the sides of the deployable solar protector 900. Alternatively, the color-coded LED lights can be moveable and/or detachable. The color-coded LED lights can include one or more rear caution lights 1006. In one case, the rear caution lights can include a red LED light bar, directed generally horizontally facing in the rear direction. The color-coded LED lights can also include one or more side caution lights 1008. In one case, the side caution lights can be manifest as an amber LED light bar, directed generally horizontally facing outward on either side of the wheelchair. The color-coded LED lights can also include one or more vision lights 1010. In one case, the vision lights can be manifest as a white LED light bar illuminating the path ahead. In other instances one or more of the lights may be affixed or otherwise attached to the support frame or to another part of the wheelchair.

The deployable solar protector 900 can also include one or more rearview mirrors 1012. In the illustrated case, the rearview mirrors are mounted on the underside of the deployable solar protector and positioned so that the person sitting in the patient contact compensating wheelchair 100 (see FIG. 9) has a view of the area behind the wheelchair. Having a view of the area behind the seated person can be advantageous for safety purposes especially for persons with limited mobility, who may not be able to easily turn and look behind them. The rearview mirror may be mounted on the left or right side of the person in the wheelchair, or on both sides. The mirror or mirrors may be contained underneath the deployable solar protector or extend outward from underneath the deployable solar protector a reasonable distance. The mirror can be adjustable by the patient and can also be configured to fold out of the way for storage of the deployable solar protector. FIG. 10B also shows an on/off switch 1014 for the lights and a battery monitor 1016 which will be further discussed below.

FIG. 11 shows a schematic of a power system 1100 for the patient contact compensating wheelchair 100. The power system can include one or more solar panels 1000. The power system and/or the wheelchair can also include one or more batteries 806(1) and 806(2), a battery charge controller 1104, a battery monitor 1016, one or more drive motors 1108, and one or more drive motor controllers 1110. Various types and/or numbers of batteries can be employed. For purposes of explanation, a pair of 12 volt batteries can be employed with 24 volt drive motors. The drive motors can be selectively coupled across the batteries in serial by the drive motor controller.

The battery charge controller 1104, such as a Fox 220 20A 12/24V 1 Battery Bank Charge Controller, can utilize power supplied by the solar panels 1000 to maintain proper charging voltage on the batteries 806(1) and 806(2) and prevent overcharging. The battery monitor 1016 can display system data such as battery charge state or status, system power, and fault diagnosis. In one implementation the battery monitor is manifest as a Fox Remote Display Unit MD1. As shown in FIG. 10B, the battery monitor (or a display thereof) can be mounted on the underside of the deployable solar protector 900 where it may be accessed (or viewed) by the person sitting in the wheelchair. In other instances, the battery monitor may be mounted in another place that is accessible by the person in the wheelchair, considering their limited mobility, such as on the wheelchair armrest. Referring again to FIG. 11, the battery or batteries 806(1) and 806(2) can be electrically connected to drive motors 1108 by the drive motor controller 1110 to drive and/or steer the wheelchair.

The power system 1100 can be configured to power and control some aspects of some of the implementations of the patient contact compensating wheelchair 100. For example, battery 806(1) and/or 806(2) can run a controller 1120 which can be configured to receive information from sensors 1122, such as the temperature sensors 316 (FIG. 3), moisture sensors, pressure sensors 506 (FIG. 5), and/or position sensors described above. The controller can use this information to control elements 1124 of the patient contact compensating system 110, such as fan 314, patient contact objects 502, and/or massage devices 600, among others. Alternatively the controller 1120 can receive input directly from the patient using the wheelchair to adjust aspects of the system. The control elements can include adjustable control for changing air flow, temperature, pressure, height, swivel, lumbar support, various massage parameters, backrest tilt, seat pan tilt, seat bottom extend-retract, headrest tilt, armrest tilt, and/or suspension, among others, in accordance with aspects of the patient contact compensating wheelchair and patient contact compensating system described above. Devices such as the fan or massage devices can stay on for as long as the seat occupant desires, can be on a timer, and/or can be tied to battery charge state.

The controls for some of the implementations can be placed individually on the wheelchair or collected on a control panel. Individual or collected controls can be provided as a joy stick, on/off switch, push button, dial, touch screen, voice activated, or other types of control. The controls can be placed in a location that can be convenient for the patient using the wheelchair, such as on the armrest. The controls may allow input by the patient using the wheelchair to control certain aspects of some implementations, such as entering a desired temperature, or setting a length of time before contact pressure is automatically redistributed. In addition to the battery monitor noted above, screens or other monitoring or feedback elements may be included on the patient contact compensating wheelchair 100, such as displays that show the patient a current contact or ambient temperature and/or a patient-entered desired temperature, parameters associated with the massage elements, or parameters associated with contact pressure of the patient, among others.

The power system can also run various accessories 1130 by connection to the batteries 806(1) and/or 806(2), either individually or in parallel, to obtain 12 volt power. For example, the accessories can include the LED lights (e.g., 1006, 1008, and 1010) (see FIG. 10B). The safety lights can be integrated with the power system with an LED driver, and also have an on/off switch 1014, such as an illuminated rocker switch which may be single pole, single throw or double pole, double throw. FIG. 10B shows the on/off switch mounted on the underside of the deployable solar protector 900, although in other instances it may be mounted in another place that is accessible by the person in the wheelchair, such as on the wheelchair armrest.

Referring again to FIG. 11, in this case, the accessories 1130 also include a 12 volt DC or other type of power port for charging electronic devices, such as a mobile phone. The power port may be mounted in any location on the wheelchair to facilitate accessibility for the person in the wheelchair, given their limited mobility, or to accommodate placement of an electronic device, such as where a mobile phone might be stored. The power port might also be incorporated with a mount that holds the mobile phone for the person. Another accessory that can be included is a BlueTooth™ type hands-free option for a mobile phone. In the case of a person with limited upper body mobility, controls for the hands-free option may be placed conveniently on the armrest so that they may initiate or receive calls easily.

Other accessories 1130 that can be included are a fan or a global positioning system (GPS) location device, among others. The fan can be fan 314 (FIG. 3) discussed above for forcing air through the wheelchair seat and/or another fan. Alternatively or additionally, other fans, such as a fan mounted on the underside of the deployable solar protector and directed toward the seat occupant can be employed. The fan can also be configured to cool any part of the patient/wheelchair.

FIGS. 12A through 12D collectively illustrate an example of the patient contact compensating wheelchair 100 with the deployable solar protector 900. The figures show the support frame 902 for attaching the deployable solar protector to the wheelchair. Other methods of attaching the deployable solar protector to a wheelchair may be used. In this example, the support frame can be constructed of hollow structural tube material in which some of the electrical wiring for the power system may be contained. Examples of hollow structural tube materials can include ferrous metals, aluminum, magnesium, titanium, composites, and/or plastics, among others. Other structures besides hollow tubes are also contemplated for use in the support frame.

The deployable solar protector support frame 902 can be attached to a structural element of the wheelchair, such as a frame of the wheelchair seat, so that the deployable solar protector 900 is positioned over the seat occupant (see FIG. 9) when deployed. In other instances the support frame may be attached to other parts of the wheelchair and may include a mounting subassembly, or may be attached directly to a part of the wheelchair without an attachment subassembly. The height of the deployable solar protector over the wheelchair seat can be adjustable for the comfort of the seat occupant, such as providing enough clearance above their head, while also keeping it close enough that they can reach any controls or switches which may be mounted on the deployable solar protector.

Figure 12A:
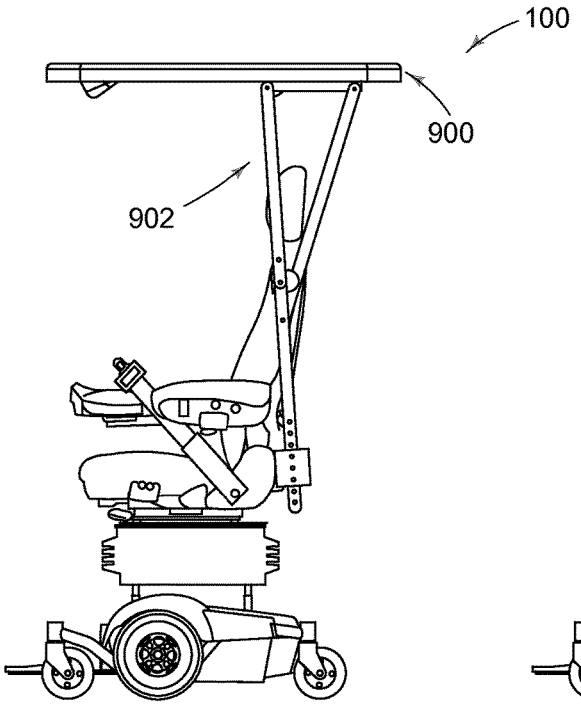
FIGS. 12A through 12D collectively illustrate example structures and methods of moving the deployable solar protector from a deployed position (e.g., protective position) to a storage position.
Figure 12B:
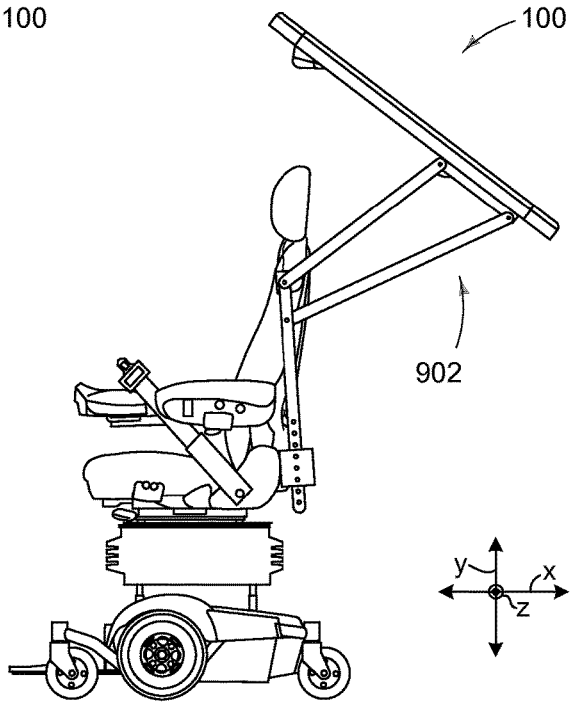
Figure 12C:
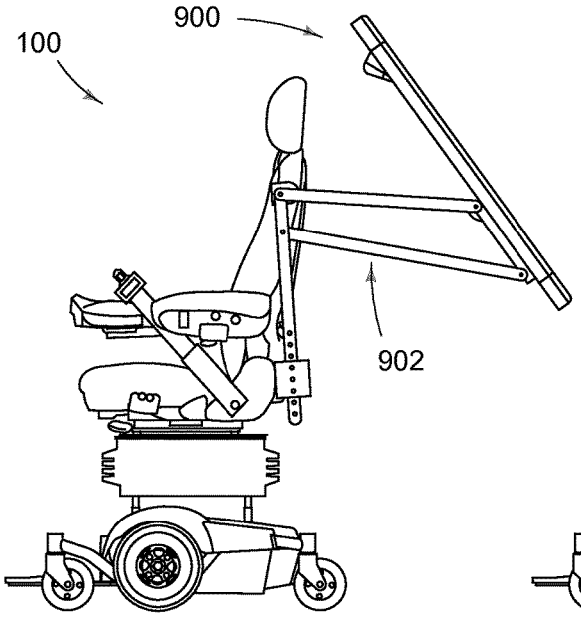
Figure 12D:
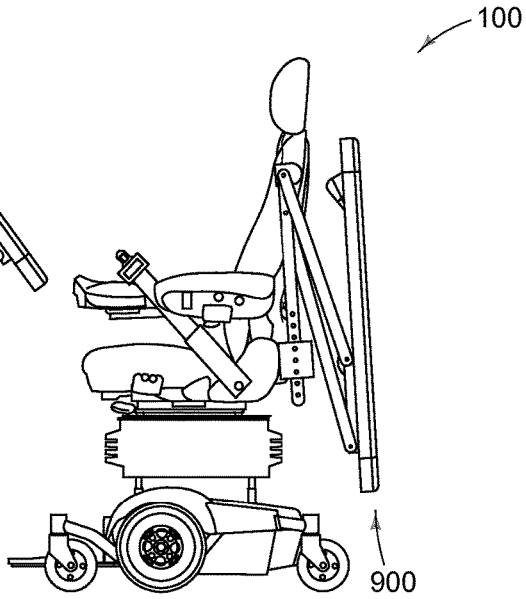

FIGS. 12A through 12D also collectively illustrate how the deployable solar protector 900 can be transitioned from the deployed position (FIG. 12A) to a support frame storage position (FIG. 12D). In this version, the deployable solar protector can be changed from the deployed position to the support frame storage position by removing a quick release pin from the support frame and lowering the deployable solar protector from the deployed position, generally horizontal over the wheelchair, to the support frame storage position, generally vertical and resting behind the seat back of the wheelchair. FIG. 12A shows the deployable solar protector in the deployed position. FIG. 12B illustrates a view where the quick release pin has been removed and the support frame is moved partway from the deployed position to the support frame storage position. FIG. 12C is a view showing both the deployable solar protector and the support frame manually lowered further from the deployed position to the support frame storage position. FIG. 12D shows the deployable solar protector in the support frame storage position and the support frame collapsed behind the back of the wheelchair seat.

Another accessory 1130 that can be included is an automatic, powered lift system for moving the deployable solar protector 900 from the deployed position to the support frame storage position and vice versa, allowing the person in the wheelchair to stay seated (shown in FIGS. 12A through 12D and further discussed below). This can be advantageous to a person with limited mobility or physical strength, who may want to raise or lower the deployable solar protector without assistance from another person in order to enter a building or access some other relatively confined space, or accommodate changing environmental conditions. The powered lift system can have controls mounted for easy access by the person seated in the wheelchair, such as on the armrest. The automatic, powered lift system may be configured to prompt the patient to initiate deployment in response to batteries reaching a predetermined minimum level.

Many other manual and/or powered deployment or lift system manifestations are contemplated beyond the illustrated configuration. These manifestations can include a multitude of different mechanical parts, frames, brackets, hinges, solenoid valves, motors, and/or controllers to accomplish moving (e.g., deploying and storing) the deployable solar protector 900. The deployable solar protector can also be configured so that its position is adjustable to accommodate different sun angles or other environmental conditions.

CONCLUSION

Although techniques, methods, devices, systems, etc. pertaining to patient contact compensating wheelchairs are described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

The invention claimed is:

1. A wheelchair, comprising:
- a motorized base; and
- a seat positioned above the motorized base; the seat comprising:
  - a moisture permeable structure configured to support a patient, a fan and an air duct configured to move air below the moisture permeable structure to carry moisture from the patient away from the moisture permeable structure,
  - moisture sensors positioned proximate to the moisture permeable structure and configured to sense moisture levels proximate to the patient at first and second portions of an underside of the moisture permeable structure, and
  - valves positioned relative to the air duct that are automatically controlled to direct more of the air to the first portion than to the second portion based at least in part by the sensed moisture levels at the first and second portions.

2. The wheelchair of claim 1, further comprising:
- a set of patient contact objects configured to alternatively contact the first portion and then the second portion of the underside of the moisture permeable structure so that at a first time more weight of the patient is supported at the first portion than at the second portion and at a second time more of the weight of the patient is supported at the second portion than at the first portion.

3. The wheelchair of claim 2, wherein the set of patient contact objects are arranged in an array or grid and wherein individual patient contact objects can be driven vertically, horizontally, and rotationally.

4. The wheelchair of claim 1, further comprising temperature sensors positioned proximate to the moisture permeable structure and configured to sense temperatures of the patient at the first and second portions and wherein operation of the fan is automatically controlled at least in part by the sensed temperatures.

5. A wheelchair, comprising:
- a motorized base; and
- a wheelchair seat that includes a patient contact compensating system that includes temperature sensors for sensing temperature at first and second contact regions between a patient and the wheelchair seat, wherein the patient contact compensating system is configured to employ a fan connected to an air duct that travels proximate to the first contact region and the second contact region and wherein the air duct is selectively controlled by a valve to lower temperature more at the first contact region than at the second contact region in response to sensed temperatures at the first and second contact regions.

6. The wheelchair of claim 5, wherein the patient contact compensating system is further configured to change pressure at the first or second contact region.

7. The wheelchair of claim 6, further comprising a set of patient contact objects, wherein the pressure is changed at the first or second contact region by moving individual patient contact objects of the set.

8. The wheelchair of claim 7, further comprising pressure sensors for monitoring the pressure at least at the first contact region and the second contact region, wherein the pressure at the first contact region and the second contact region is changed in response to monitoring the pressure.

9. The wheelchair of claim 5, wherein the temperature is lowered by flowing air proximate to the first and second contact regions.

10. The wheelchair of claim 5, further comprising moisture sensors for monitoring moisture at the first and second contact regions, wherein the moisture is lowered by flowing air proximate to the first and second contact regions in response to monitoring the moisture.

11. A wheelchair, comprising:
- a motorized base that includes a battery;
- a seat fastened to the motorized base; and
- a patient contact compensating system comprising a fan that is connected to an air duct that travels under the seat and a valve for selectively controlling airflow through the air duct, wherein the patient contact compensating system is configured to:
  - sense moisture at multiple contact regions between a patient and the seat, and
  - in response to the moisture, selectively lower the moisture proximate to individual contact regions by controlling airflow to the individual contact regions with the valve.

12. The wheelchair of claim 11, wherein the patient contact compensating system is in the seat.

13. The wheelchair of claim 12, wherein the patient contact compensating system is further configured to lower the moisture by controlling air flow through the air duct with the valve that lowers the moisture at the individual contact regions.

* * * * *